US008439158B2

(12) United States Patent
Tanase et al.

(10) Patent No.: US 8,439,158 B2
(45) Date of Patent: May 14, 2013

(54) ACOUSTIC RESONATOR AND SOUND CHAMBER

(75) Inventors: Rento Tanase, Iwata (JP); Keiichi Fukatsu, Hamamatsu (JP)

(73) Assignee: Yamaha Corporation, Hamamatsu-Shi, Shizuoka-ken (JP)

( * ) Notice: Subject to any disclaimer, the term of this patent is extended or adjusted under 35 U.S.C. 154(b) by 0 days.

(21) Appl. No.: 12/955,318

(22) Filed: Nov. 29, 2010

(65) Prior Publication Data

US 2011/0127107 A1 Jun. 2, 2011

(30) Foreign Application Priority Data

Nov. 30, 2009 (JP) ..... 2009-272891
Oct. 26, 2010 (JP) ..... 2010-239875

(51) Int. Cl.
*F01N 1/04* (2006.01)

(52) U.S. Cl.
USPC ..... 181/250; 181/276

(58) Field of Classification Search ..... 181/224, 181/229, 230, 250, 266, 273, 276, 293, 403
See application file for complete search history.

(56) References Cited

U.S. PATENT DOCUMENTS

| | | | | |
|---|---|---|---|---|
| 4,924,966 | A * | 5/1990 | Kanda et al. | 181/228 |
| 5,493,080 | A * | 2/1996 | Moss | 181/232 |
| 5,996,733 | A * | 12/1999 | DeTuncq et al. | 181/250 |
| 2005/0155815 | A1 * | 7/2005 | Sasaki et al. | 181/151 |
| 2009/0205901 | A1 * | 8/2009 | Tanase et al. | 181/151 |

FOREIGN PATENT DOCUMENTS

| | | | |
|---|---|---|---|
| JP | 07-302087 | A | 11/1995 |
| JP | 08-121142 | A | 5/1996 |

* cited by examiner

*Primary Examiner* — Jeremy Luks
(74) *Attorney, Agent, or Firm* — Dickstein Shapiro LLP

(57) ABSTRACT

An acoustic resonator adaptable to a sound chamber is designed to decrease a sound pressure while increasing a particle velocity of medium particles in a low frequency range without increasing the overall size thereof. The acoustic resonator is constituted of a pipe member having one opening end and a resistance member embracing a high resistance region and a low resistance region. The resistance member is inserted into the pipe member such that one end thereof matches the opening end of the pipe member while the other end thereof is disposed at a predetermined position inside a hollow cavity of the pipe member. The high resistance region embraces an antinode region of the particle velocity distribution with respect to a standing wave occurred in the hollow cavity at a resonance frequency, thus causing an acoustic phenomenon decreasing the resonance frequency compared to a single unit of the pipe member.

28 Claims, 12 Drawing Sheets

ACOUSTIC RESONATOR AND SOUND CHAMBER

BACKGROUND OF THE INVENTION

1. Field of the Invention

The present invention relates to acoustic resonators and sound chambers.

The present application claims priority on Japanese Patent Application No. 2009-272891 and Japanese Patent Application No. 2010-239875, the contents of which are incorporated herein by reference.

2. Description of the Related Art

Conventionally, a variety of sound absorbing structures using acoustic resonators has been developed and disclosed in various documents such as Patent Documents 1 and 2.

Patent Document 1: Japanese Patent Application Publication No. H07-302087

Patent Document 2: Japanese Patent Application Publication No. H08-121142

Patent Document 1 discloses a sound absorbing structure aimed at reducing sound pressure in a low frequency range, wherein a plurality of resonance pipes having different lengths, each of which has an opening end and an opposite closed end, adjoins with their opening ends. Patent Document 2 discloses an intake noise reduction device of an internal combustion engine, which shifts a resonance frequency into a low frequency range by way of a resonance chamber communicating with an intake duct via a communicating tube. Patent Document 2 employs a Helmholtz resonator equivalent to a spring-mass resonance system in which an air of the communicating tube serves as a mass component while an air of the resonance chamber serves as a spring component and in which a sound absorbing material is attached to a certain part of the communicating tube. In the Helmholtz resonator, an internal air of the sound absorbing material serves as a mass component, which is increased to cause a resonance frequency to shift into a lower frequency range compared with another resonator precluding a sound absorbing material.

The sound absorbing structure of Patent Document 1 needs to increase the length of a cavity of each resonance pipe as its resonance frequency decreases so as to decrease sound pressure at a low frequency via a resonance phenomenon; hence, each resonance pipe needs to be increased in size. The Helmholtz resonator of Patent Document 2 is formed in a certain shape having sufficient dimensions securing a uniform distribution of sound pressure relative to an incidence direction of sound waves (or a height direction of the Helmholtz resonator) in a resonance chamber. That is, the Helmholtz resonator is designed to fix a constant sound pressure in a resonance chamber. In addition, the resonance chamber needs to increase its volume as its resonance frequency decreases, so that the width dimension of the resonator may become larger than the height dimension of the resonator. This makes it difficult to install the resonator due to interference with peripheral components. In the case of a Helmholtz resonator demonstrating a sound absorption effect at 160 Hz, for example, it needs to increase the overall size such that the diameter is set to 145 mm while the height is set to 130 mm approximately.

SUMMARY OF THE INVENTION

It is an object of the present invention to provide an acoustic resonator which is able to reduce sound pressure without increasing the size thereof.

It is another object of the present invention to provide an acoustic resonator which is able to increase the velocity of medium particles in a low frequency range.

It is a further object of the present invention to provide a sound chamber using an acoustic resonator.

An acoustic resonator of the present invention is constituted of a pipe member having at least one opening end and embracing a hollow cavity therein, and a resistance member inserted into the pipe member with a predetermined length which is shorter than the overall length of the hollow cavity of the pipe member. The resistance member includes a high resistance region and a low resistance region so as to present different resistances to the motion of medium particles in the hollow cavity of the pipe member. The high resistance region adjoins the low resistance region in a cross section of the hollow cavity of the pipe member having the resistance member. A region causing variations of a sound pressure at a resonance frequency is disposed inside the hollow cavity in the length direction In the above, the high resistance region comes in contact with an external space at the opening end of the pipe member. Specifically, one end of the high resistance region is commensurate with the opening end of the pipe member while the other end thereof is disposed at a predetermined position inside the hollow cavity of the pipe member. In addition, the low resistance region communicates between the external space and the internal space inside of the hollow cavity of the pipe member.

The high resistance region embraces an antinode region of the particle velocity distribution of a standing wave occurred in the hollow cavity of the pipe member at the resonance frequency. The high resistance region is elongated from the opening end of the pipe member to the antinode region. The high resistance region is attached onto the interior surface of the pipe member so that the high resistance region encompasses the low resistance region in a cross section of the hollow cavity of the pipe member having the resistance member.

A sound chamber of the present invention includes the above acoustic resonator comprised of a pipe member and a resistance member. The sound chamber refers to soundproof rooms, halls, theaters, listening rooms equipped with audio devices, conference rooms, compartments of transportation systems and vehicles, and housings of speakers and musical instruments, for example.

The present invention improves effects of decreasing sound pressure while increasing particle velocity in a low frequency range without increasing the overall size of an acoustic resonator.

BRIEF DESCRIPTION OF THE DRAWINGS

These and other objects, aspects, and embodiments of the present invention will be described in more detail with reference to the following drawings.

DESCRIPTION OF THE PREFERRED EMBODIMENTS

Figure 1:
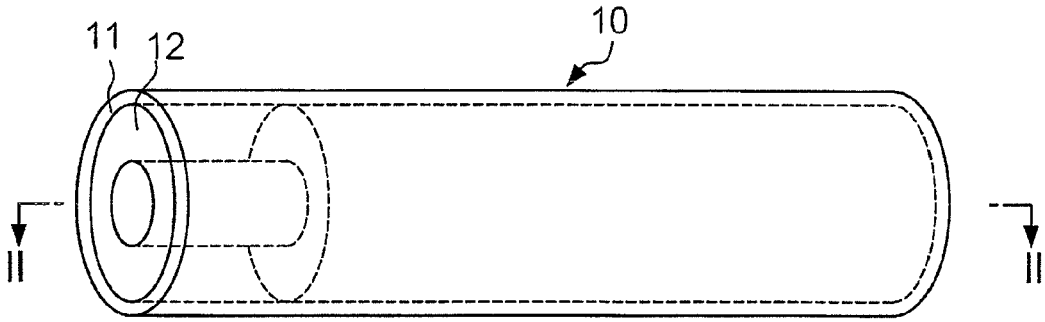
FIG. 1 is a perspective view of an acoustic resonator constituted of a pipe member and a resistance member according to a first embodiment of the present invention.

The present invention will be described in further detail by way of examples with reference to the accompanying drawings, wherein parts identical to those shown in various drawings are designated by the same reference numerals.

1. First Embodiment

FIG. 1 is a perspective view of an acoustic resonator 10 according to a first embodiment of the present invention. The acoustic resonator 10 has a cylindrical pipe shape having an opening end (at a left side) and an opposite closed end (at a right side). The acoustic resonator 10 is divided into a pipe member 11 and a resistance member 12. The pipe member 11 (serving as a housing of the acoustic resonator 10) is formed in a cylindrical shape composed of a metal or plastics. The pipe member 11 having one opening end is elongated in a length direction. The resistance member 12 is a cylindrically shaped component which is defined between opposite circular faces and in which a cylindrical cavity runs through the center portion in a length direction. The resistance member 12 is engaged inside the opening of the pipe member 11 such that the exterior surface of the resistance member 12 comes in contact with the interior surface of the pipe member 11 in proximity to its opening end. The resistance member 12 is composed of a porous material such as urethane foam, wherein it causes a resistance to the motion of air particles (e.g. air molecules), thus constraining air particles from moving freely. Compared to the pipe member 11 precluding the resistance member 12, it is possible to increase the resistance to the motion of air particles in the area of the resistance member 12. A characteristic impedance of a medium (i.e. air particles) may represent a quantitative physical value of the resistance.

Figure 2:
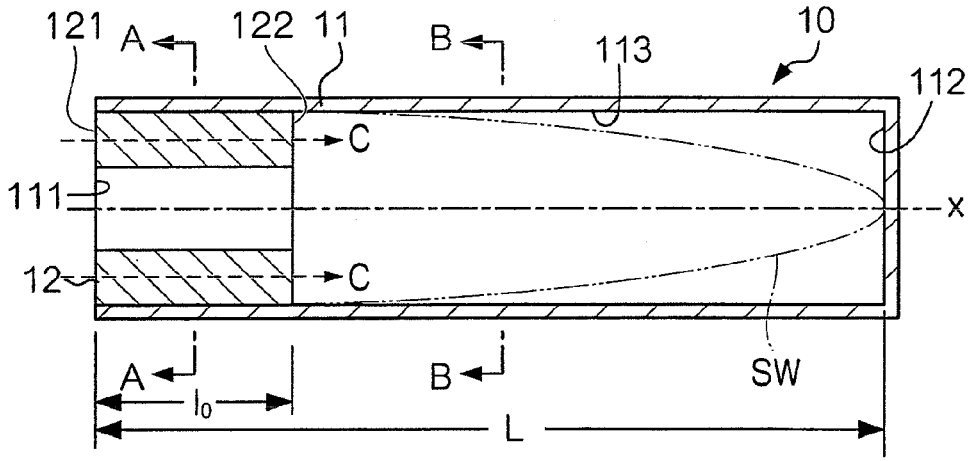
FIG. 2 is a longitudinal sectional view of the acoustic resonator take along line II in FIG. 1.
Figure 3A:
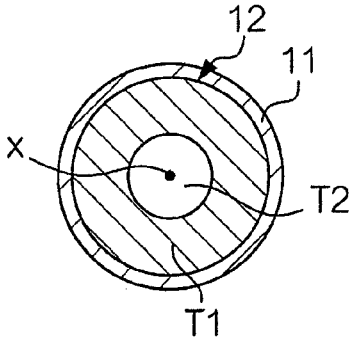
FIG. 3A is a cross-sectional view taken along line A-A in FIG. 2.
Figure 3B:
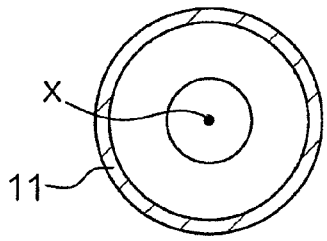
FIG. 3B is a cross-sectional view taken along line B-B in FIG. 2.

FIG. 2 is a longitudinal sectional view of the acoustic resonator 10 taken along line II in FIG. 1. The section shown in FIG. 2 is taken from the pipe member 11 in the length direction with respect to a plane including a center axis X. FIGS. 3A and 3B are cross-sectional view of the acoustic resonator 10 with respect to a plane perpendicular to the length direction of the pipe member 11. The cross sections shown in FIGS. 3A and 3B are taken from the pipe member 11 with respect to a plane perpendicular to the length direction of a hollow cavity 113 between opposite ends. FIG. 3A is a cross-sectional view taken along line A-A in FIG. 2 at a position traversing the pipe member 11 including the resistance member 12. FIG. 3B is a cross-sectional view taken along line B-B in FIG. 2 at a position traversing the pipe member 11 precluding the resistance member 12. In this connection, the same shape and dimensions are secured with respect to the cross section of the pipe member 11 including the resistance member 12 at an arbitrary position. In addition, the same shape and dimensions are secured with respect to the cross section of the resistance member 12. The length direction of the pipe member 11 is equivalent to the length of the hollow cavity 113 between an opening end 111 and a closed end 112. That is, the length direction corresponds to a line segment connecting opposite ends.

The length of the pipe member 11 is defined between the opening end 111 and the closed end 112 which are opposite to and distanced from each other. The present embodiment is designed based on the assumption that the closed end 112 may serve as a perfectly reflecting surface (or a rigid wall) in terms of acoustics. The hollow cavity 113 having a cylindrical shape is formed inside the pipe member 11 and elongated between the opening end 111 and the closed end 112. The hollow cavity 113 communicates with the external space via the opening end 111, while the hollow cavity 113 is shut out from the external space via the closed end 112. In this connection, "L" denotes the length of the hollow cavity 113 commensurate with the distance between the opening end 111 and the closed end 112. In addition, the center axis X (see a dashed line) is commensurate with a center line connecting the centers of cross sections perpendicular to the length direction of the hollow cavity 113.

The diameter of the hollow cavity 113 of the pipe member 111 is smaller than a half of a wavelength of a standing wave occurred in a diameter direction in terms of a one-dimensional sound field. The hollow cavity 113 is elongated along the center axis X in the length direction; hence, sound waves propagating inside the hollow cavity 113 are simply assumed as plane waves which propagate along the center axis X. In the present embodiment, a sound pressure is uniformly distributed in all the cross sections of the hollow cavity 113 perpendicular to the center axis X.

The resistance member 12 is installed in the hollow cavity 113 such that one end thereof is precisely positioned at the opening end 111. The resistance member 12 has a cylindrical shape whose length direction matches the center axis X. In this connection, "$l_0$" denotes the length of the resistance member 12 between opposite ends. A cavity having a cylindrical shape is formed inside the resistance member 12 in the length direction. The cavity of the resistance member 12 partially occupies the hollow cavity 113 of the pipe member 11 between the opening end 111 and the closed end 112. No resistance material increasing a resistance to the motion of air particles is provided in the cavity of the resistance member 12.

FIG. 3A shows the cross section of the pipe member 11 including the resistance member 12, which is constituted of a high resistance region T1 (having a high resistance to the motion of air particles) and a low resistance region T2 (having a low resistance to the motion of air particles). The low resistance region T2 is lower in resistance than the high resistance region T1. The high resistance region T1 embraces a resistance material actually serving as a resistance to the motion of air particles, while the low resistance region T2 does not embrace a resistance material in correspondence with the cavity running through the resistance member 12 in the length direction. In the cross section of the pipe member 11 including the resistance member 12 shown in FIG. 3A, the high resistance region T1 having a doughnut-like shape encompasses the low resistance region T2 having a circular shape.

The resistance member 12 is defined between a first surface 121 (which is positioned at the opening end 111 of the hollow cavity 113) and a second surface 122 (which is opposite to the first surface 121). The first surface 121 of the resistance member 12 is positioned in direct contact with the external space of the pipe member 11 in connection with the opening end 111 of the hollow cavity 113. The second surface 122 of the resistance member 12 is disposed inside the hollow cavity 113. Both the first surface 121 and the second surface 122 embrace the high resistance region T1 and the low resistance region T2.

In the present embodiment, the normal direction of the resistance member 12 on the first surface 121 and the second surface 122 is commensurate with the length direction of the hollow cavity 113. However, it is possible to modify the present embodiment such that the normal direction of the resistance member 12 may cross the length direction of the hollow cavity 113.

The low resistance region T2 is composed of the same medium as the external space (disposed in contact with the opening end 111 of the acoustic resonator 10) and the internal space (disposed inside the acoustic resonator 10 precluding the resistance member 12). In short, the low resistance region T2 is filled with air. In this connection, the low resistance region T2 may embrace the center axis X. Alternatively, the low resistance region T2 may have a point-symmetry sectional whose center is commensurate with the center axis X. Alternatively, the low resistance region T2 may preclude the center axis X. In short, the high resistance region T1 of the resistance member 12 is elongated in the length direction of the hollow cavity 113 so as to partially occupy the hollow cavity 113, wherein the cross section thereof is perpendicular to the length direction of the hollow cavity 113 in FIG. 3A. The cross section of the hollow cavity 113 precluding the resistance member 12 is composed of the same medium (or the same material) as the low resistance region T2 in FIG. 3B.

The acoustic resonator 10 of the present embodiment needs to incorporate the resistance member 12 because of the following observation.

Figure 4:
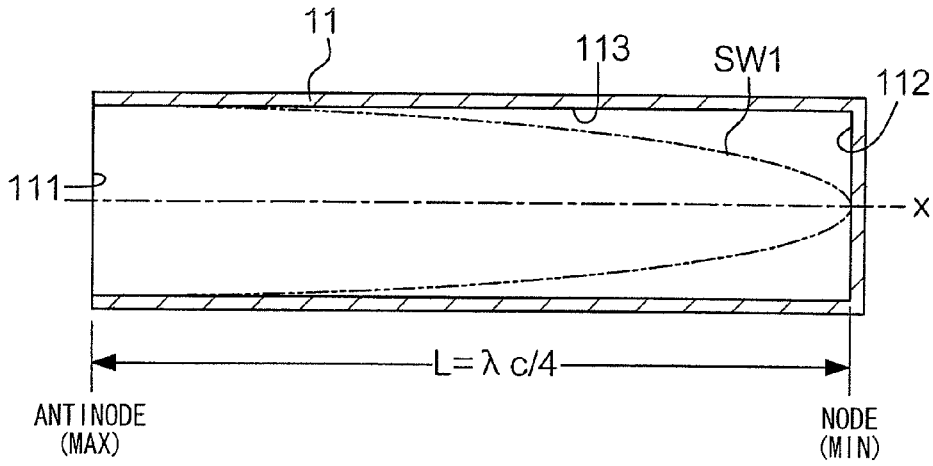
FIG. 4 is a longitudinal sectional view of the pipe member precluding the resistance member, in which a standing wave occurs in response to a sound wave resonating inside a hollow cavity of the pipe member.
Figure 5:
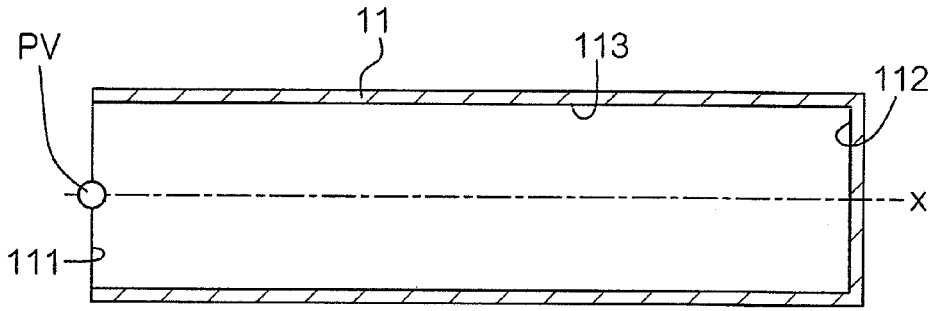
FIG. 5 is a longitudinal sectional view of the pipe member, which is measured in a resonance frequency and a loss factor.

FIG. 4 is a longitudinal sectional view of the pipe member 11 precluding the resistance member 12 (i.e. a single unit of the pipe member 11), which is cut along a plane including the center axis X. A dashed line (or a two-dotted line) represents a particle velocity distribution (or an amplitude distribution) with respect to a standing wave SW1 having the lowest frequency (i.e. a first-mode resonance frequency) among standing waves which may occur inside the pipe member 11.

As shown in FIG. 4, standing waves occur in the hollow cavity 113 of the pipe member 11 to meet a boundary condition in which particle velocity becomes zero at the closed end 112. That is, the standing wave SW1 has a node of the particle velocity distribution at the position of the closed end 112 at which a particle velocity becomes minimum. An antinode of the particle velocity distribution is disposed at the position of the opening end 111 at which a particle velocity is highest. When the pipe member 11 has a resistance component so that the closed end 112 does not serve as a perfectly reflecting surface, a node and an antinode of the particle velocity distribution may be deviated in position while they still exist in the hollow cavity 113 of the pipe member 11 shown in FIG. 4. In this connection, the following description does not refer to an opening end correction.

The standing wave SW1 occur owing to a resonance of the pipe member 11 in response to a sound wave of a wavelength $\lambda c$ (where $L=\lambda c/4$) which is four times longer than the length L of the hollow cavity 113. A reflected wave whose phase differs from the phase of an incident wave occurs via resonance in the pipe member 11. The reflected wave is emitted into the external space via the opening end 111 of the pipe member 11. Owing to a phase difference between the reflected wave and the incident wave, sound waves having a resonance frequency (commensurate with the wavelength λc) interfere with each other and cancel out each other, thus demonstrating a sound pressure reduction effect in proximate to the opening end 111 with respect to the resonance frequency. At this time, air particles are involved in a repetitive oscillation with the maximum amplitude in proximate to the opening end 111 owing to the occurrence of the standing wave SW1. This increases a motion velocity (or a particle velocity) of air particles in proximity to the opening end 111 at frequencies other than the resonance frequency. The acoustic resonator 10 operates similar to a single unit of the pipe member 11 (generally known as an acoustic pipe) in a resonance mode such that a particle velocity distribution may occur owing to the standing wave SW1 (similar to a standing wave SW shown in FIG. 2). For this reason, the acoustic resonator 10 in which the pipe member 11 embraces the resistance member 12 undergoes local variations of sound pressure at the resonance frequency such that regions having different sound pressures may emerge at various positions in the length direction of the hollow cavity 113 along the center axis X. That is, regions having different sound pressures emerge at two or more positions in the length direction of the hollow cavity 113 with respect to the resonance frequency. In other words, the resonance frequency cannot fix a constant sound pressure in the sound pressure distribution but undergoes fluctuating sound pressures at various positions in the length direction of the hollow cavity 113. The inventors of the present invention have performed measurement to confirm whether or not the resonance frequency undergoes fluctuating sound pressures at various positions in the length direction of the hollow cavity 113. Measurement results will be described in the latter part of the specification.

In the acoustic resonator 10 constituted of the pipe member 11 having one opening end, the length L of the hollow cavity 113 needs to be decreased one quarter of the wavelength λc of the resonance frequency. In other words, the length L of the hollow cavity 113 needs to be increased in order to decrease the resonance frequency. To solve such a drawback, the inventors of the present invention have introduced the foregoing structure of the acoustic resonator 10 constituted of the pipe member 11 embracing the resistance member 12, thus demonstrating effects of decreasing sound pressure while increasing particle velocity without increasing the overall size. The inventors have confirmed that such an effect can be significantly enhanced in a low frequency range.

The inventors have prepared various types of acoustic resonators with different factors and dimensions in adapting the resistance member 12 to the pipe member 11; thereafter, the inventors have performed measurement on acoustic resonators in terms of the resonance frequency and loss factor.

The measurement is performed based on the following precondition. First, the same structure of the pipe member 11 is adapted to each acoustic resonator. The dimensions of the pipe member 11 are determined to achieve a resonance frequency of 223 Hz according to calculation, wherein L=380 mm. The particle velocity is measured using a particle velocity sensor disposed at the center of the opening end 111 commensurate with the center axis X. The particle velocity sensor measures particle velocities at different frequencies upon incidence of sound waves whose frequencies range from 10 Hz to 500 Hz at the opening end 111. A loss factor g is calculated using the measurement result of particle velocity in accordance with a half band width method. Specifically, frequencies $f_1$ and $f_2$ at which a particle velocity is 3 dB lower than a peak value of particle velocity are measured, subsequently, a difference of $f_1-f_2$ is divided by a first-mode resonance frequency $f_0$, thus producing the loss factor g. The loss factor g indicates the sharpness of the frequency characteristic around the peak value of particle velocity, wherein a smaller value of the loss factor g indicates a sharper frequency characteristic.

Figure 6:
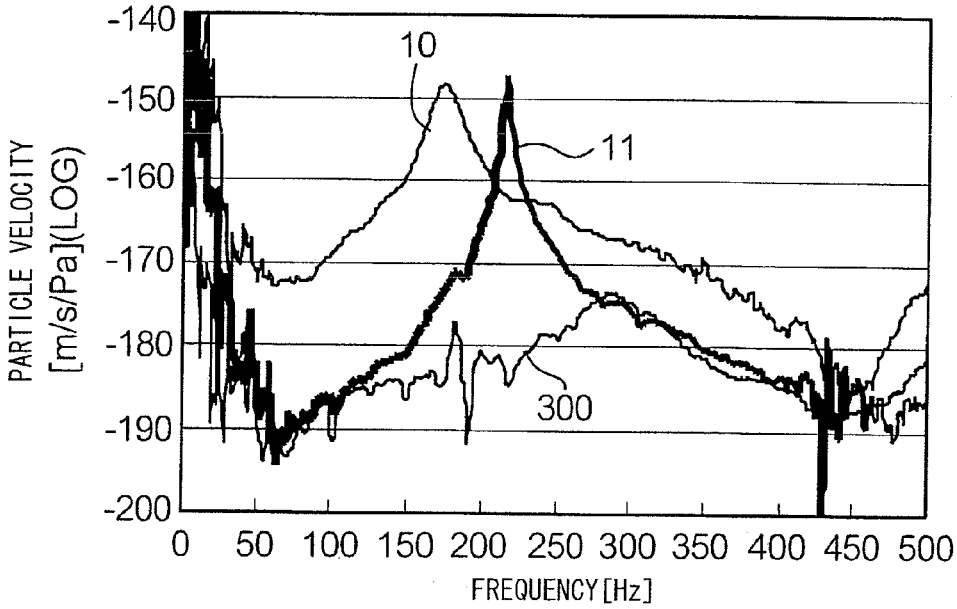
FIG. 6 is a graph showing frequency characteristics of particle velocities with respect to acoustic resonators.
Figure 7:
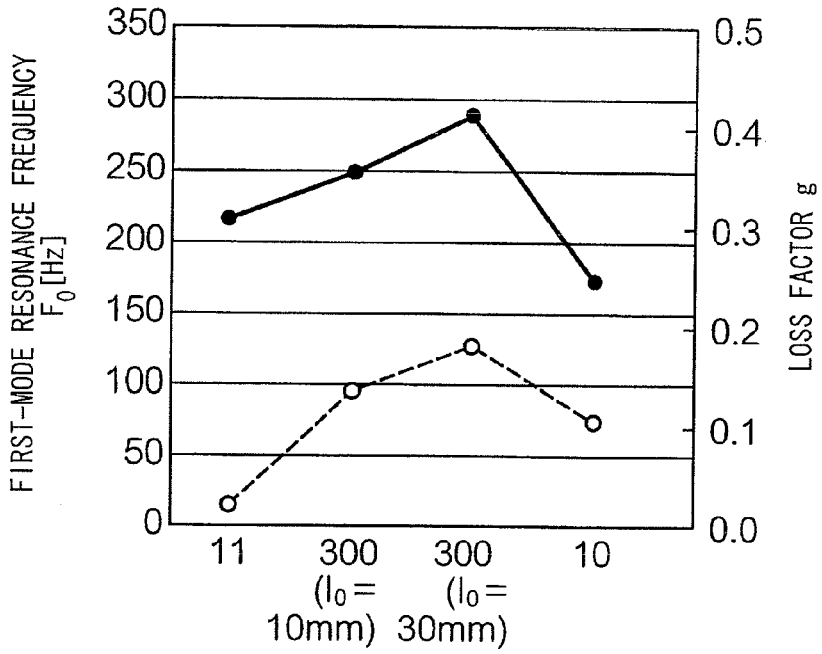
FIG. 7 is a graph showing the first-mode resonance frequency and the loss factor in connection with various types of acoustic resonators.
Figure 8:
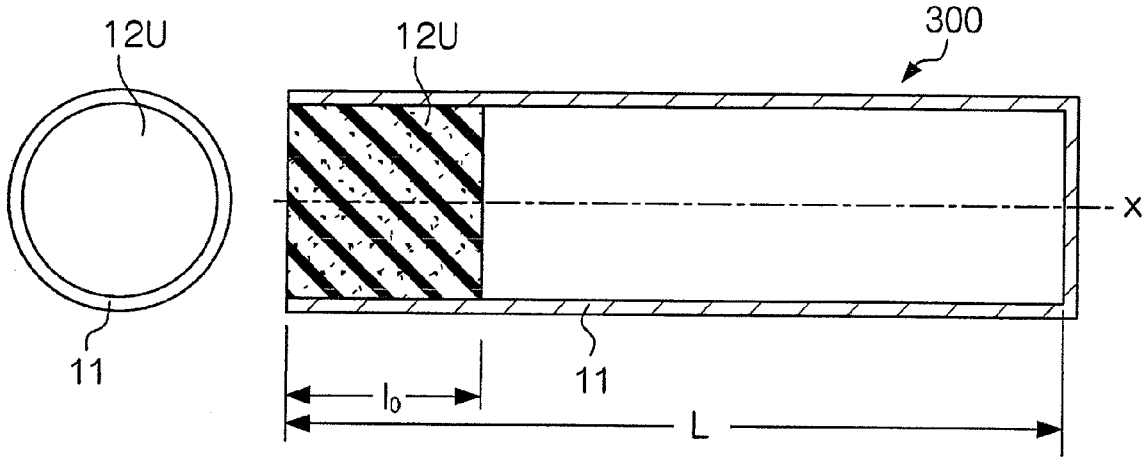
FIG. 8 is a longitudinal sectional view of a comparative acoustic resonator incorporating urethane foam in a pipe member.

FIG. 6 is a graph showing the frequency characteristics of particle velocities which are measured with respect to various types of acoustic resonators, wherein, the horizontal axis represents frequency [Hz] while the vertical axis represents particle velocity [m/s/Pa] scaled based on a sound pressure of a sound wave incident at the opening end 111. FIG. 7 is a graph showing the first-mode resonance frequency $f_0$ and the loss factor g in connection with various types of acoustic resonators, wherein the horizontal axis represents types of acoustic resonators while the vertical axes represent the first-mode resonance frequency [Hz] and the loss factor g. The resonance frequency $f_o$ is plotted at black dots connected with solid lines, while the loss factor g is plotted at white dots connected with dotted lines. FIG. 6 shows the measurement result of an acoustic resonator simply constituted of the pipe member 11 shown in FIG. 4, the measurement result of the acoustic resonator 10 shown in FIG. 1, and the measurement result of a comparative acoustic resonator 300 of FIG. 8 in which the pipe member 11 embraces an urethane foam 12U (serving as a resistance member) having a cylindrical shape. FIG. 8 shows a cross section of the acoustic resonator 300 in view of the opening end 111 perpendicular to the center axis X and a longitudinal section of the acoustic resonator 300 in view of a plane along the center axis X. The urethane foam 12U having a length of $l_0$=30 mm is put into the pipe member 11 so as to completely close the opening end 111 in the acoustic resonator 300. FIG. 7 shows two measurement results of the comparative acoustic resonator 300 (where $l_0$=30 mm and $l_0$=10 mm) in addition to the measurement result of an acoustic resonator simply constituted of the pipe member 11 and the measurement result of the acoustic resonator 10 in which the resistance member 12 has a length of $l_0$=30 mm.

FIG. 6 shows that the particle velocity is peaked at approximately 220 Hz with respect to the acoustic resonator simply constituted of a single unit of the pipe member 11. The frequency causing a peak of the particle velocity represents the resonance frequency of the acoustic resonator. In the standing wave corresponding to the first-mode resonance frequency, the particle velocity is maximized at the position of the opening end 111. FIG. 7 shows that the loss factor g of the pipe member 11 is very low at about 0.02, FIG. 6 shows a high sharpness at about the peak frequency of the particle velocity. With respect to the pipe member 11, an actually measured value of the resonance frequency is equivalent to the calculated value of the resonance frequency, wherein a high value of the particle velocity close to its peak value appears in a small frequency range. With respect to the acoustic resonator 300 (where $l_0$=30 mm), the particle velocity is peaked at approximately 300 Hz. That is, the acoustic resonator 300 whose opening end 111 is closed with the resistance member 12U may shift the resonance frequency in a high frequency range, whilst the loss factor g is close to 0.2 which is a relatively high value. That is, the acoustic resonator 300 has a peak value of the particle velocity in a broad frequency range whilst the peak value of the particle velocity is relatively low. This indicates that the acoustic resonator 300 is inferior to the acoustic resonator simply constituted of the pipe member 11 in terms of a sound pressure reduction effect and a particle velocity increase effect at the resonance frequency. FIG. 7 shows that the acoustic resonator 300 (where $l_0$=10 mm) is suppressed in operation compared to the acoustic resonator 300 (where $l_0$=30 mm) in terms of an effect of shifting the resonance frequency into a high frequency range and an effect of increasing the loss factor g; however, the resonance frequency thereof is higher than that of the acoustic resonator simply constituting of the pipe member 11.

FIG. 6 shows that the particle velocity is peaked at approximately 170 Hz with respect to the acoustic resonator 10, which indicates that the resonance frequency of the acoustic resonator 10 is lower than the resonance frequency of the pipe member 11, whilst a peak value of the particle velocity is equivalent to that of the pipe member 11. This indicates that acoustic resonator 10 is commensurate with the pipe member 11 in terms of a sound pressure reduction effect and a particle velocity increase effect at the resonance frequency. FIG. 7 shows that the loss factor g of the acoustic resonator 10 is approximately 0.1, which is higher than the loss factor g of the pipe member 11. Compared to the pipe member 11, the acoustic resonator 10 causes a peak value of the particle velocity at a lower resonance frequency and in a broader frequency range. That is, the acoustic resonator 10 is able to reliably demonstrate a sound pressure reduction effect and a particle velocity increase effect.

Compared with the pipe member 11, the acoustic resonator 10 is able to enhance a sound pressure reduction effect and a particle velocity increase effect in connection with a resonance frequency and a frequency range.

Figure 9:
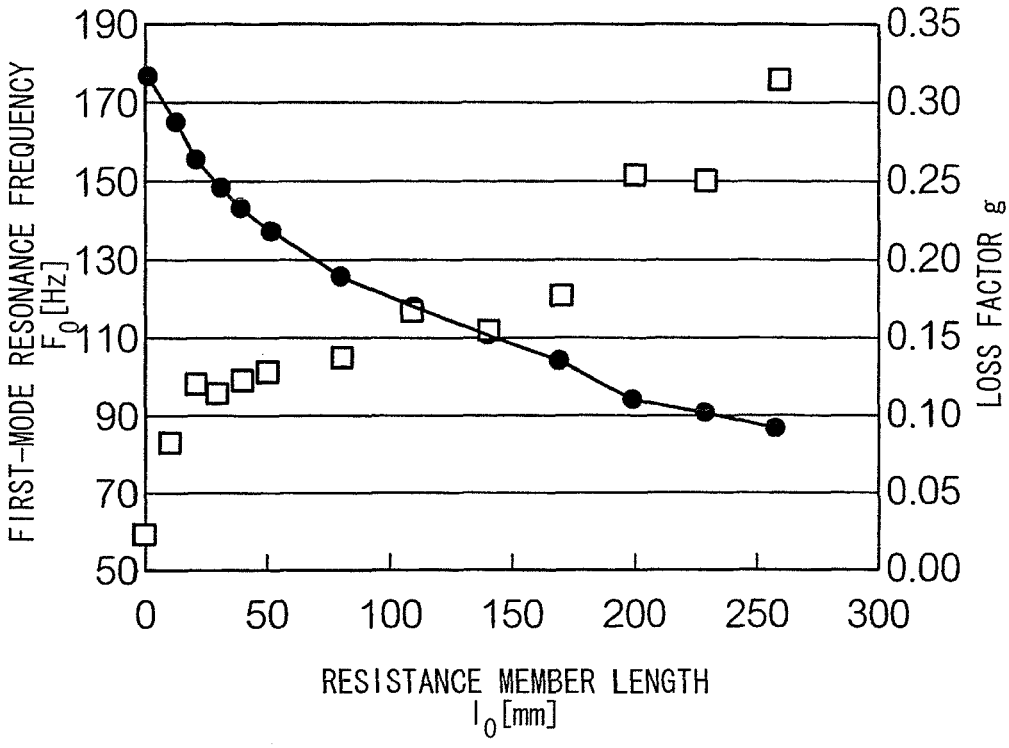
FIG. 9 is a graph showing the first-mode resonance frequency and the loss factor in connection with various lengths of resistance members.

The inventors have measured the first-mode resonance frequency $l_0$ and the loss factor g by changing the length $l_0$ of the resistance member 12 of the acoustic resonator 10. FIG. 9 is a graph showing the first-mode resonance frequency f0 (which is plotted with black dots connected via solid lines) and the loss factor g (which is plotted with white square marks) in connection with various values of the length $l_0$ of the resistance member 12. In FIG. 9, the horizontal axis represents the length $l_0$ of the resistance member 12, the left-side vertical axis represents the first-mode resonance frequency $f_0$, and the right-side vertical axis represents the loss factor g, wherein the length L of the acoustic resonator 10 is set to 480 mm.

FIG. 9 shows that the resonance frequency of the acoustic resonator 10 is shifted into a lower frequency range as the length $l_0$ of the resistance member 12 becomes larger. The acoustic resonator 10 undergoes the resonance frequency of approximately 175 Hz without the resistance member 12 (where l0=0 mm), whilst the resonance frequency is decreased to 90 Hz with the resistance member 12 where l0=262 mm. In addition, the loss factor g tends to increase as the length $l_0$ of the resistance member 12 increases. The pipe member 11 without incorporating the resistance member 12 (where $l_0$=0 mm) undergoes the loss factor g of approximately 0.02, whilst the loss factor g is increased to approximately 0.3 with the resistance member 12 (where $l_0$=262 mm). This indicates that as the length $l_0$ of the resistance member 12 increases, a shift value of the resonance frequency being shifted into a lower frequency range increases, and the loss factor g increased as well.

Figure 10:
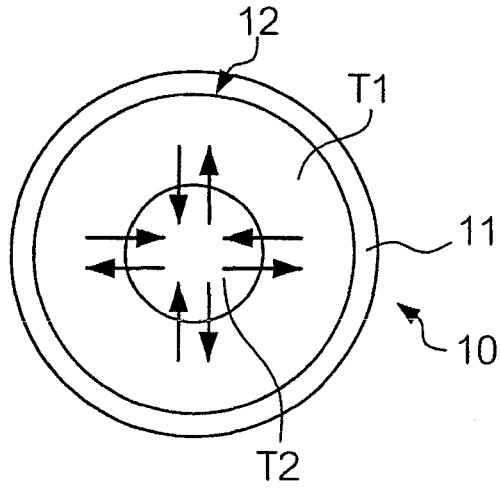
FIG. 10 is a plan view illustrating an acoustic phenomenon occurred in the opening end of the acoustic resonator with a high resistance region and a low resistance region.

The inventors have studies the reason why the resonance frequency f0 and the loss factor g change in connection with the length $l_0$ of the resistance member 12 with reference to FIG. 10. FIG. 10 is a plan view of the opening end 111 of the acoustic resonator 10, illustrating an acoustic phenomenon occurred in the acoustic resonator 10.

In the pipe unit 11, plane waves propagate along the center axis X so that a sound pressure may be uniformly distributed in a cross-sectional direction perpendicular to the center axis X. In contrast, the acoustic phenomenon of FIG. 10 occurs in the acoustic resonator 10 in which the resistance member 12 is installed in the hollow cavity 113 of the pipe member 11, which includes the high resistance region T1 and the low resistance region T2. As sound waves propagate inside the hollow cavity 113 in the length direction from the opening end 111 to the closed end 112, a propagation velocity of sound waves propagating through the high resistance region T1 is lower than a propagation velocity of sound waves propagating through the low resistance region T2 since the high resistance region T1 hinders the motion of air particles. Due to a difference of propagation velocity between the high resistance region T1 and the low resistance region T2, phase differences may occur in wave fronts of sound waves propagating through those regions T1 and T2. Phase differences lead to discontinuity of wave fronts of sound waves in a cross-sectional plane (perpendicular to the center axis X) at the boundary between the high resistance region T1 and the low resistance region T2; this causes a new flow of air particles to cancel out phase differences. Subsequently, a new flow of air particles causes an energy flow of sound waves in arrow directions in FIG. 10, thus causing an acoustic energy loss due to a mutual interference between sound waves. In summary, the inventors have figured out the mutual relationship between the high resistance region T1 and the low resistance region T2, allowing for an air movement in parallel with a cross-sectional plane perpendicular to the center axis X.

In each of the high resistance region T1 and the low resistance region T2, a standing wave occurs in the length direction of the hollow cavity 113 due to an overlapped phenomenon between incoming sound waves (propagating in a direction from the opening end 111 to the closed end 112) and reflected sound waves. In the acoustic resonator 10, the resistance member 12 is arranged in a certain region corresponding to an antinode of the particle velocity distribution with respect to a standing wave occurred in the hollow cavity 113. The resistance member 12 may further enhance the above acoustic phenomenon since it is arranged in a certain region causing an active motion of air particles. In addition, the length dimension of the resistance member 12 (which is elongated in the hollow cavity 113) and the width dimension of the high resistance region T1 (i.e. the thickness of the resistance member 12) may greatly affect an acoustic energy loss. Owing to the above acoustic phenomenon, the acoustic resonator 10 may increase the loss factor g while significantly shifting the resonance frequency $f_0$ into a low frequency range. This is confirmed by the measurement results of FIGS. 6 and 7.

The present embodiment adopts the urethane foam as a material of the resistance member, whereas it is possible to adopt other materials which reliably hinder the motion of air particles while increasing the resistance to the motion of air particles. The urethane foam is an example of open-cell porous materials, whereas it is possible to adopt other open-cell porous materials such as resin foams. In this connection, open-cell porous materials have an open-cell structure in which cells are interconnected to each other so as to allow for an air flow (or an air circulation) therebetween. Alternatively, it is possible to adopt closed-cell porous materials at least in part, wherein closed-cell porous materials have a closed-cell structure in which cells are independent from each other. The resistance member 12 is not necessarily composed of porous materials having numerous apertures; hence, it is possible to adopt other materials serving as a porous structure for sound waves. For example, it is possible to adopt glass wools in which glass fibers are entangled with each other so as to serve as a porous structure. Alternatively, it is possible to adopt cloth materials (in which cloths are woven together), non-woven cloth materials, and metal fiber panels. Moreover, it is possible to adopt metal (e.g. aluminum foams, metal fiber panels), wooden materials (e.g. wooden tips, wooden fragments), paper (e.g. wooden fibers, pulp fibers), glass (e.g. microperforated panels (MPP), micropore panels, other glass materials forming micropores via etching), and plant/animal fibers (e.g. cattle hair felts, recovered felts, wools, cottons, non-woven fabrics, cloths, synthetic fibers, wooden powder, paper materials). As described above, the resistance member 12 can be composed of various materials allowing for air circulation and hindering of the motion of air particles. In the resistance member 12, the high resistance region T1 encompasses the low resistance region T2, which closures an air communication between the external space of the pipe member 11 and the hollow cavity 113 via the first surface 121 and the second surface 122. Thus, incoming waves propagate through the hollow cavity 113 inwardly of the high resistance region T1 in an arrow direction C in FIG. 2, while reflected waves propagate in an opposite direction.

The inventors have performed measurement on variations of sound pressure at a resonance frequency (owing to the resonance of the hollow cavity 113 of the acoustic resonator 10) in connection with positions in the length direction of the pipe member 11. The measurement is performed using a sample of the acoustic resonator 10 in which the pipe member 11 has a diameter of 40 mm; the length L of the hollow cavity 113 is 380 mm; the resistance member 12 has a cylindrical shape in which the length $l_0$ is 30 mm; and the resistance member 12 is composed of an urethane foam whose thickness is 10 mm. Herein, the resistance member 12 is installed in the pipe member 11 such that one end thereof is commensurate with the opening end 111 of the pipe member 11.

Figure 11:
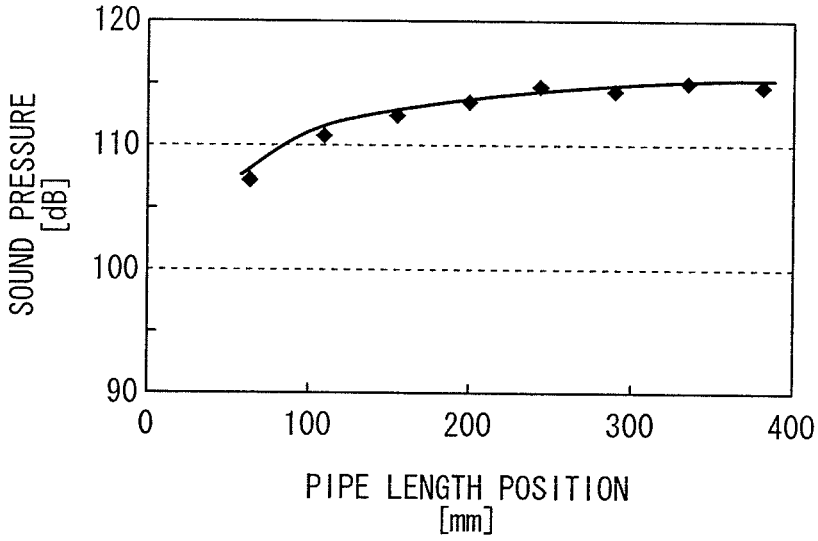
FIG. 11 is a graph showing variations of sound pressure in connection with the length of a hollow cavity of the acoustic resonator.

FIG. 11 is a graph showing the result of measurement using the above sample of the acoustic resonator 10 in conjunction with Table 1, wherein the horizontal axis represents the pipe length position [mm] which is measured from the opening end 111 in the length direction of the hollow cavity 113 and the vertical axis represents the sound pressure [dB] at the first-mode resonance frequency $f_0$, which is set to 195.75 Hz. An initial pipe length position is set to 0 nun which is commensurate with the opening end 111, while a last pipe length position is set to 380 mm which is commensurate with the closed end 112. The measurement is performed in such a way that a speaker emitting a measurement sound with a certain sound pressure at 195.75 Hz is positioned 1 m apart from the opening end 111 of the acoustic resonator 10; subsequently, a microphone is set to each measurement position in the high resistance region T2 in the hollow cavity 113 of the pipe member 11, thus measuring the sound pressure at each measurement position.

TABLE 1

| Pipe Length Position [mm] | Sound Pressure [dB] |
|---|---|
| 380 | 115.03 |
| 335 | 115.2 |
| 290 | 114.55 |
| 245 | 114.82 |
| 200 | 113.52 |
| 155 | 112.38 |
| 110 | 110.68 |
| 65 | 107.12 |

The graph of FIG. 11 and Table 1 clearly indicate a tendency in which the measured sound pressure increases as the pipe length position increases to depart from the opening end 111 in the length direction of the hollow cavity 113. At a resonance mode of the acoustic resonator 10, the hollow cavity 113 apparently embraces regions causing sound-pressure variations at the resonance frequency in the length direction. It is well known that a single unit of the pipe member 11 undergoes a resonance phenomenon causing sound-pressure variations at a resonance frequency. Owing to the resonance phenomenon, sound-pressure variations occur at the resonance frequency in connection with the pipe length position inside the hollow cavity 113.

As described above, the acoustic resonator 10 is able to decrease the resonance frequency compared to the resonance frequency of the pipe member 11 since the resistance member 12 is appropriately arranged in the hollow cavity 113 of the pipe member 11, wherein the internal diameter of the pipe member 11 (or the diameter of the cylindrically shaped hollow cavity 113) is smaller than the length of the pipe member 11 (or the length of the hollow cavity 113). As shown in FIGS. 1 and 2, the resistance member 12 is arranged inside the pipe member 11 in such a way that the low resistance region T2 is surrounded by the high resistance region T1 in a certain cross section of the hollow cavity 113 having the resistance member 12 in the length direction. With this structure, it is possible to enhance a particle velocity increase effect and a sound pressure reduction effect in a low frequency range without increasing the overall length of the acoustic resonator 10. Considering limited spaces facilitating noise suppression structures, the present embodiment is advantageous in that the acoustic resonator 10 can be reduced in size compared to the size of the foregoing acoustic resonator constituted of a single unit of the pipe member 11, thus demonstrating a degree of freedom in facility. The present embodiment can offer a desired sample of the acoustic resonator 10 demonstrating a sound absorption effect at approximately 160 Hz, for example, in which the diameter of the opening end 111 is set to 40 mm, and the length of the hollow cavity 113 is set to 480 mm. Compared to the foregoing Helmholtz resonator, the present embodiment needs merely a one-third volume in dimensions. Unlike the foregoing Helmholtz resonator, the acoustic resonator 10 of the present embodiment may hardly cause a troublesome interference with peripheral components.

2. Second Embodiment

In the first embodiment, the high resistance region T1 of the resistance member 12 is laid along the interior surface of the pipe member 11 so as to encompass the low resistance region T2 in a certain cross section of the hollow cavity 113 of the pipe member 11 having the resistance member 12. The foregoing acoustic phenomenon occurs in a cross section of the hollow cavity 11 having the resistance member 12, in which the high resistance region T1 adjoins the low resistance region T2, thus demonstrating a sound pressure reduction effect and a particle velocity increase effect at a resonance frequency.

FIGS. 12A through 12D, FIGS. 13A and 13B, and FIGS. 14A and 14B show various structures adapted to the acoustic resonator 10 according to a second embodiment of the present invention, wherein those drawings are longitudinal sectional views each out with a plane including the center axis X.

Figure 12A:
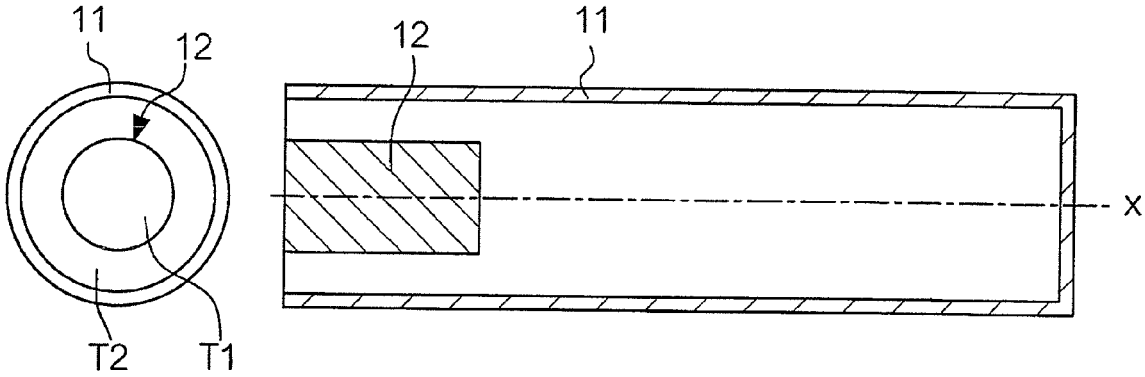
FIG. 12A is a longitudinal sectional view showing an acoustic resonator according to a second embodiment of the present invention, wherein a resistance member is modified in terms of a high resistance region and a low resistance region.

FIG. 12A shows that the high resistance region T1 and the low resistance region T2 are changed in position in the resistance member 12. As shown in a left-side illustration of FIG. 12A illustrating the opening end 111 of the pipe member 11, the resistance member 12 is modified in such a way that the high resistance region T1 is surrounded by the low resistance region T2 in a cross section of the hollow cavity 113 having the resistance member 12 in the length direction. The resistance member 12 having the high resistance region T1 needs to be supported via a certain fixing structure (not shown) so as not to hinder the resonance phenomenon. The fixing structure adapted to the resistance member 12 is not necessarily supported by the pipe member 11 but it can be supported by a wall or the like facilitating the acoustic resonator 10 of the second embodiment, wherein the resistance member 12 needs to be supported in a midair manner inside the hollow cavity 113 of the pipe member 11.

Figure 12B:
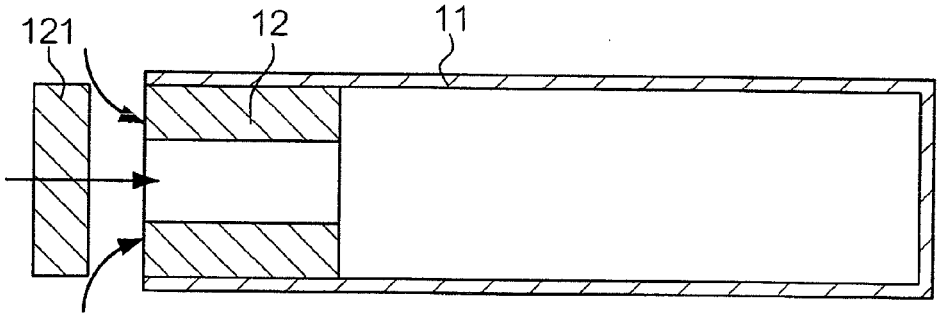
FIG. 12B is a longitudinal sectional view of the acoustic resonator additionally equipped with a secondary resistance member outside the opening end, of the pipe member.
Figure 12C:
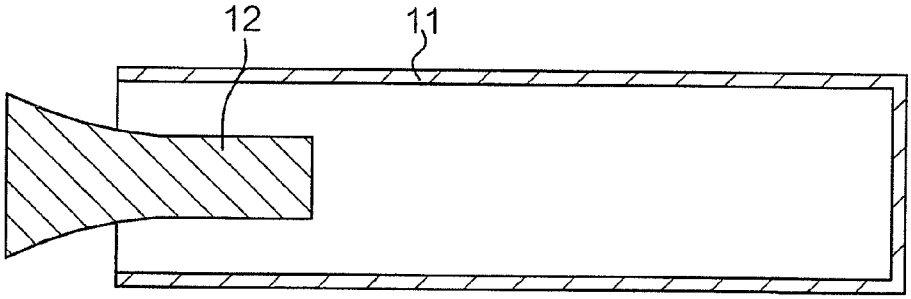
FIG. 12C is a longitudinal sectional view of the acoustic resonator in which the resistance member is modified to change its cross-sectional size in the length direction of the pipe member.

FIG. 12B shows that a secondary resistance member 121 is externally of the hollow cavity 113 of the pipe member 11 of the acoustic resonator 10. The secondary resistance member 121 is positioned opposite to the opening end 111 of the pipe member 11. The secondary resistance member 121 can be supported by an external structure such as a wall, or it can be supported by the pipe member 11. Since sound waves are incident at the opening end 111 in different directions (see arrows in FIG. 12B), two flows of sound waves occur depending on whether or not sound waves propagate through the resistance members 12 and 121, thus causing deviations of propagation velocities of sound waves. This causes the foregoing acoustic phenomenon so as to shift the resonance frequency into a low frequency range. FIG. 12C shows that the shape and dimensions of the resistance member 12 changes along the center axis X in the length direction. Specifically, the cross-sectional size of the resistance member 12 gradually decreases in the length direction from the opening end 111 to the closed end 112. The resistance member 12 can be partially protruded from the opening end 111 of the pipe member 11. Of course, the resistance member 12 does not need to be protruded from the opening end 111 of the pipe member 11. In addition, the cross-sectional size of the resistance member 12 does not need to be regularly varied along the center axis X in the length direction.

Figure 12D:
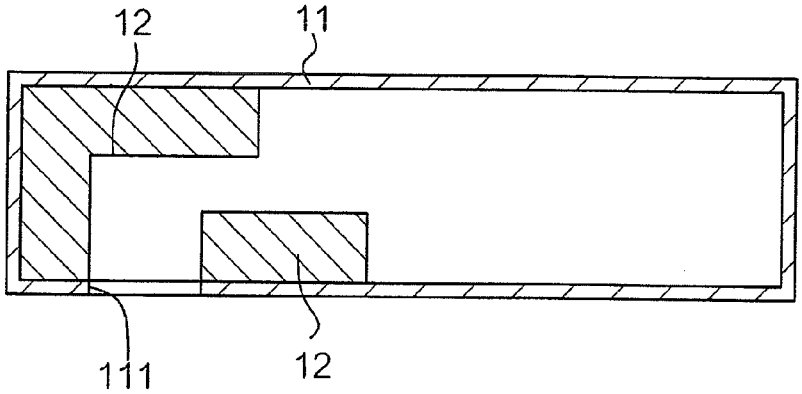
FIG. 12D is a longitudinal sectional view of the acoustic resonator in which both ends of the pipe member are closed while an opening is formed on the side portion of the pipe member.

The pipe member 11 does not need to have the closed end 112 opposite to the opening end 111. FIG. 12D shows that both ends of the pipe member 11 are closed while an opening 111A is formed at a certain position on the side portion of the pipe member 11 in proximity to its closed end. In this structure, when a standing wave occurs in the pipe member 11, the particle velocity at the first-mode resonance frequency is maximized in a center area in the length direction of the hollow cavity 113 of the pipe member 11. The foregoing acoustic phenomenon may occur when another unit of the resistance member 12 is attached onto the interior surface of the pipe member 11 at an intermediate position in the length direction of the hollow cavity 113.

Figure 13A:
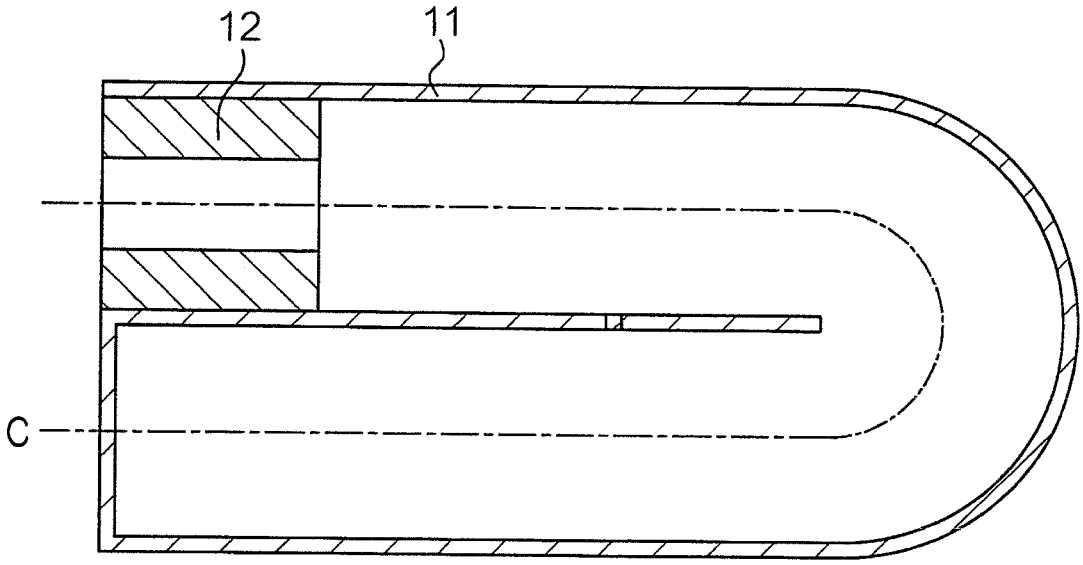
FIG. 13A is a longitudinal sectional view of the acoustic resonator in which the pipe member is folded to form a U-shaped hollow cavity.
Figure 13B:
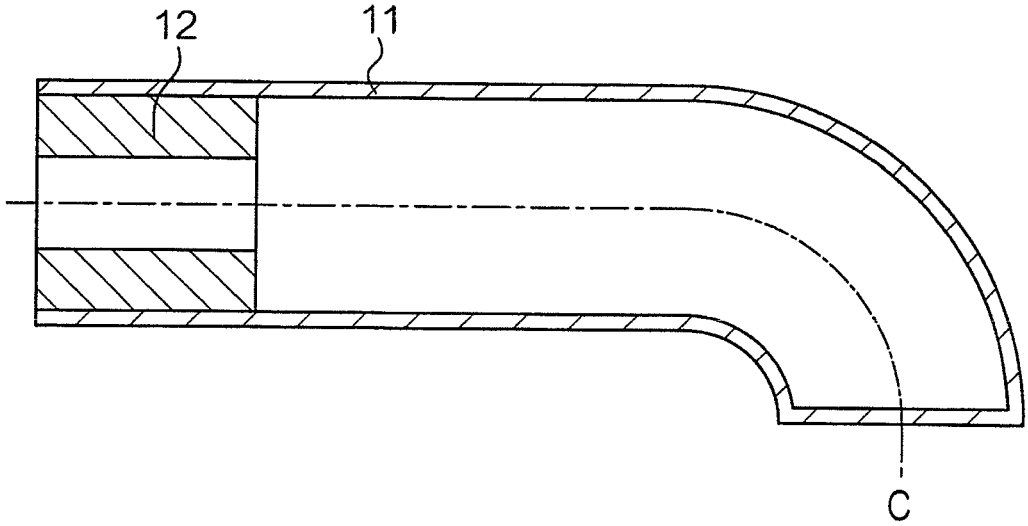
FIG. 13B is a longitudinal sectional view of the acoustic resonator in which the pipe member is curved in proximity to its closed end.

The pipe member 11 is not necessarily straightened in shape to form a hollow cavity elongated in one direction. FIG. 13A shows that the pipe member 11 is bent and folded to form a U-shaped hollow cavity therein. Since the pipe member 11 is folded to embrace a U-shaped hollow cavity, it is possible to reduce the straight length in one direction, thus improving a degree of freedom in facilitating. FIG. 13B shows a curved shape of the pipe member 11 which is not straightened in shape. In this connection, the folded shape of the pipe member 11 can freely set the number of folded portions and the folding direction in FIG. 13A, whilst the curved shape of the pipe member 11 can freely set the number of curved portions and the curving direction in FIG. 1B.

Basically, the acoustic resonator 10 is designed such that the pipe member 11 is elongated to straighten the hollow cavity 113 in the center axis X connecting the center points of the cross sections perpendicular to the length direction. When the hollow cavity 113 is curved, a string of the center points of the cross sections may be curved in a tangential direction of the center axis X. Preferably, the cured shape of the pipe member 11 have fixed dimensions of area with respect to all cross sections inside the hollow cavity 113 so that differences of propagation paths (or optical path differences) between incoming sound waves and reflected sound waves may fall within a tolerant range.

Figure 14A:
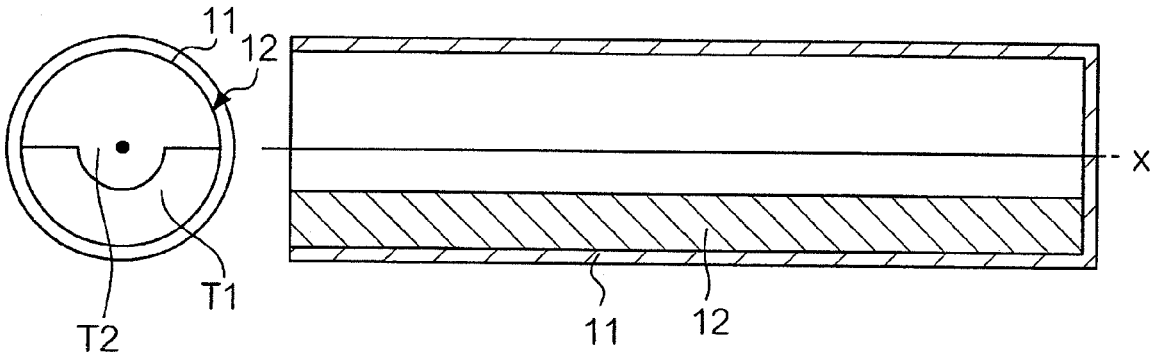
FIG. 14A is a longitudinal sectional view of the acoustic resonator in which the resistance member is elongated and attached onto the interior surface of the pipe member so as to occupy approximately a half of a cross-sectional area of the pipe member.
Figure 14B:
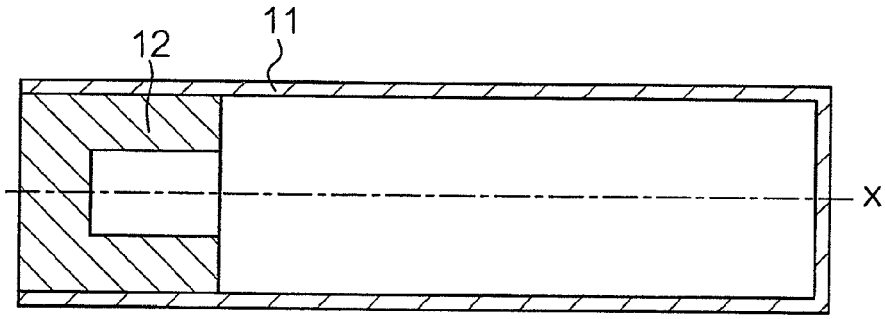
FIG. 14B is a longitudinal sectional view of the acoustic resonator in which the opening end of the pipe member is completely closed with the resistance member, in which the low resistance region is formed partly inside the high resistance region so as to communicate with the internal space of the hollow cavity.

In the hollow cavity 113 of the pipe member 11, the low resistance region T2 is not necessarily surrounded by the high resistance region T1 in a cross section perpendicular to the length direction along the center axis X. FIG. 14A shows that the resistance member 12 is elongated and attached onto the interior surface of the pipe member 11 so that the high resistance region T1 occupies approximately the lower half area in the cross section of the pipe member 11 (see a left-side illustration of FIG. 14A illustrating the opening end 111), wherein the high resistance region T1 partially encompasses the low resistance region T2. In FIG. 14A, the resistance member 12 is elongated from one end to the other end of the hollow cavity 113 with the length of $L=l_0$, whereas it is possible to shorten the length l0 of the resistance member 12 where $L>l_0$. The high resistance region T1 does not necessarily adjoin the low resistance region T2 at the cross section of the pipe member 11 perpendicular to the center axis X. FIG. 14B shows that the opening end 111 of the pipe member 11 is completely closed with the resistance member 12, wherein high resistance region T1 partly embraces the low resistance region T2 in a certain cross section of the pipe member 11 perpendicular to the center axis X, thus allowing the low resistance member T2 to communicate with the internal space of the hollow cavity 113 in the direction toward the closed end 112. In this connection, the present embodiment allows the resistance member 12 to close the hollow cavity 113 at a certain part of the pipe member 11.

3. Third Embodiment

Figure 15A:
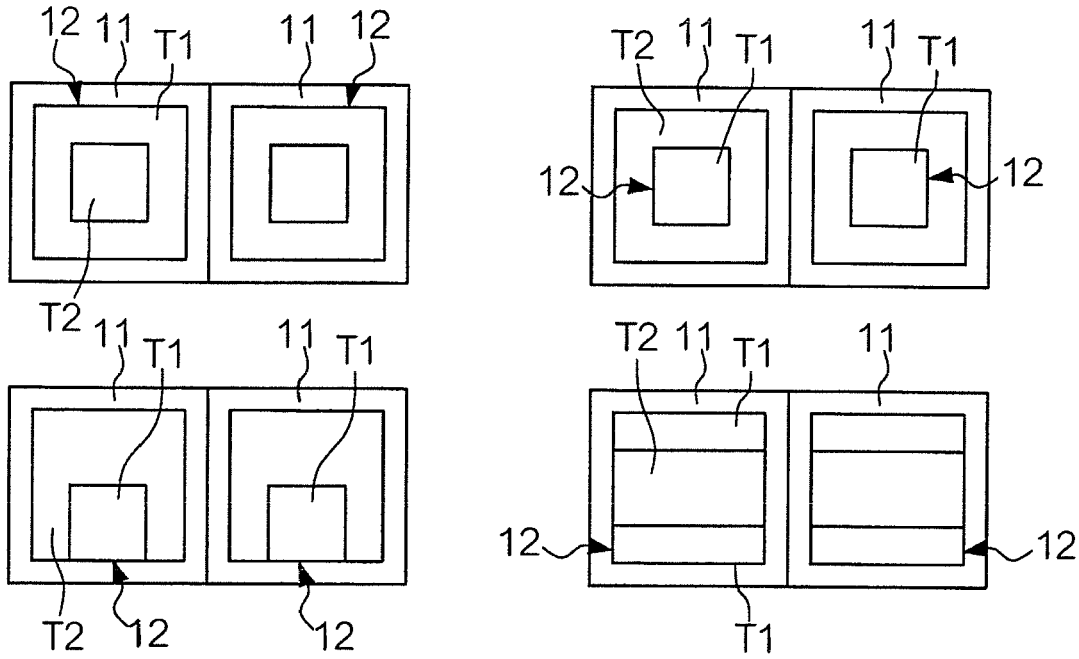
FIG. 15A shows four variations in terms of the structure of an acoustic resonator according to a third embodiment of the present invention, wherein the pipe member and the resistance member are each formed in a rectangular or square shape.
Figure 15B:
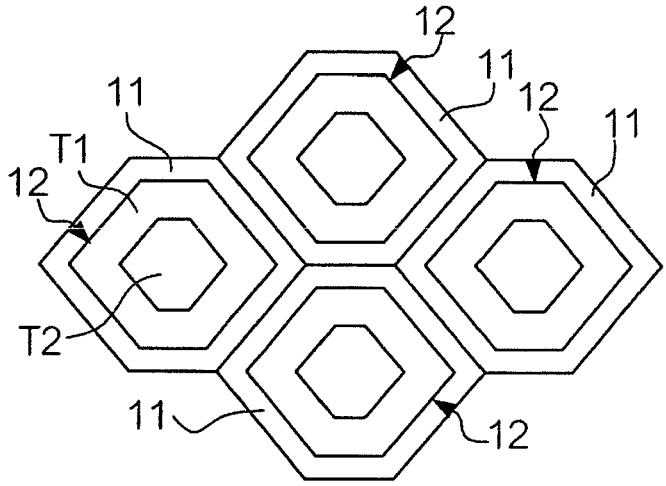
FIG. 15B shows another variation of the third embodiment of the acoustic resonator in which a hexagonal resistance member is installed in a hexagonal pipe member.

The foregoing embodiments are designed such that the opening end 111 has a circular shape whilst the cross section of the pipe member 11 has a circular shape along the center axis X; but this is not a restriction. FIGS. 15A and 15B show variations of shapes with respect to the opening end 111 and the cross section of the pipe member 11 adapted to the acoustic resonator 10 according to a third embodiment of the present invention.

FIG. 15A shows four variations of shapes and arrangements with respect to the resistance member 12 adapted to the pipe member 11 whose opening end is formed in a rectangular shape (or a square shape). The third embodiment may partially adopt the second embodiment in terms of the positional relationship between the high resistance region T1 and the low resistance region 12. In an upper-left illustration of FIG. 15A, the low resistance region T2 is surrounded by the high resistance region T1 in the resistance member 12 installed in the pipe member 11. In an upper-right illustration of FIG. 15A, the high resistance region T1 is surrounded by the low resistance region T2 in the resistance member 12 installed in the pipe member 11. In a lower-left illustration of FIG. 15A, the high resistance region T1 is reduced in size and attached onto one side of the interior surface of the pipe member 11, wherein the high resistance region T1 is encompassed within the low resistance region T2. In a lower-right illustration of FIG. 15A, the resistance member 12 is divided into two parts which are attached onto opposite sides of the interior surface of the pipe member 11, wherein the low resistance region T2 is sandwiched between two high resistance regions T1.

FIG. 15A shows that the resistance member 12 is arranged inside the pipe member 11 so as to form the low resistance region T2 having a rectangular shape (or a square shape), whereas it is possible to modify the acoustic resonator 10 such that the cross-sectional shape of the pipe member 11 differs from the cross-sectional shapes of the high resistance region T1 and the low resistance region T2.

FIG. 15B shows that the pipe member 11 is formed in a hexagonal prism shape, wherein the high resistance region T1 and the low resistance region T2 are adjusted in cross-sectional shape in conformity with the hexagonal cross-sectional area of the hollow cavity 113 of the pipe member 11. In this case, it is possible to heap a plurality of "hexagonal" acoustic resonators together as shown in FIG. 16B.

These variations of shapes are illustrative and not restrictive; hence, it is possible to adopt other shapes such as polygonal shapes having numerous apexes. In addition, the resistance member 12 is not necessarily shaped in conformity with the cross-sectional shape of the pipe member 11; hence, it is possible to adopt circular shapes, rectangular envelope shapes, honey-comb shapes, and lattice shapes. Furthermore, a single acoustic resonator may include a plurality of pipe members having different arrangements of resistance members.

It is not necessary to secure the same shape and dimensions with respect to all cross sections of the pipe member 11 perpendicular to the length direction along the center axis X. The shape of the housing (e.g. the pipe member 11) of the acoustic resonator 10 is not necessarily limited to the pipe shape but can be formed in other shapes such as rectangular envelope shapes. In short, the housing of the acoustic resonator 10 can be formed using any types of structures demonstrating acoustic properties, each of which needs to include a hollow cavity elongated in one direction and an opening end allowing the hollow cavity to communicate with the external space.

4. Fourth Embodiment

Figure 16:
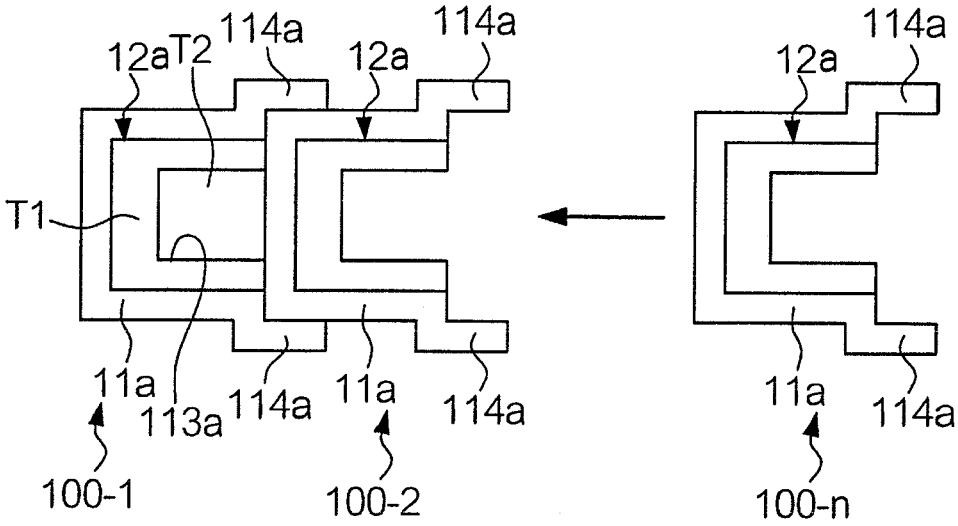
FIG. 16 is a sectional view showing an acoustic resonator according to a fourth embodiment of the present invention, which is formed using a plurality of resonant units.

In the foregoing embodiments, the acoustic resonator 10 is formed using a single unit of the pipe member 11; but it is possible to adopt a plurality of units which are assembled together into an acoustic resonator. FIG. 16 shows an acoustic resonator according to a fourth embodiment of the present invention viewed from the opening end. The acoustic resonator of the fourth embodiment is formed by assembling a plurality of resonance units 100, each of which is three-dimensionally elongated in a vertical direction perpendicular to the two-dimensional drawing sheet of FIG. 16. The resonant units 100 are each constituted of a housing 11*a* and a resistance member 12*a*, which are similarly formed in a "rectangular" U-shape in a cross-sectional view. The resistance member 12*a* is engaged inside the housing 11*a* such that the exterior surface of the resistance member 12*a* is attached to the interior surface of the housing 11*a*. The housing 11*a* having the resistance member 12*a* is rotated in a clockwise direction by 90 degrees so that the opening side thereof is directed rightwards in FIG. 16. Specifically, a plurality of resonant units (which are labeled with numerals of 100-1, 100-2, . . . , 100-*n* from the left to the light in FIG. 16, where "n" is an integer not less than two) is combined to adjoin together with their opening sides. The housing 11*a* has two fitting portions 114*a* which holds the closed side (or projected portion) of the next housing 11*a*; hence, a plurality of resonant units 100 is sequentially connected together with their fitting portions 114*a*. Herein, the opening side of the housing 11*a* is closed with the closed side of the next housing 11*a* so as to form a hollow cavity 113*a* encompassed by the U-shaped resistance member 12*a*, thus demonstrating a resonance phenomenon. Preferably, the resonance units 100 need to be tightly connected together so that they are not manually separated from each other with ease. In this connection, the hollow cavity 113*a* of the housing 11*a* has one opening end and an opposite closed end.

Upon combining "n" resonance units 100, it is possible to form "n−1" hollow cavities 113*a*, thus achieving "n−1" acoustic resonators. Herein, one hollow cavity 113*a* can be formed using one or two resonant units 100, whereas it is possible to form a plurality of hollow cavities 113*a* by use of three or more housings 11*a*. In this connection, it is possible to use a single resonant unit 100 whose opening side is closed with a wall or other members.

FIG. 16 shows the housing 11*a* having a "rectangular" U-shape, which can be changed with a "round" U-shape, wherein it is possible to adopt various shapes as the housing 11*a* and the resistance member 12*a*. Alternatively, the housing 11*a* is reshaped to have a plurality of opening sides, so that a plurality of resonant units 100 can be combined together in various directions.

5. Fifth Embodiment

In order to achieve a resonance effect in a broad frequency range, a plurality of resonators having different resonance frequencies needs to be aligned together. A plurality of resonance pipes having different lengths realizing different resonance frequencies can be aligned to achieve a resonance effect in a broad frequency range. Instead, a plurality of acoustic resonators (which are described in the foregoing embodiments) can be unified together to enhance a sound pressure reduction effect and a particle velocity increase effect.

Figure 17:
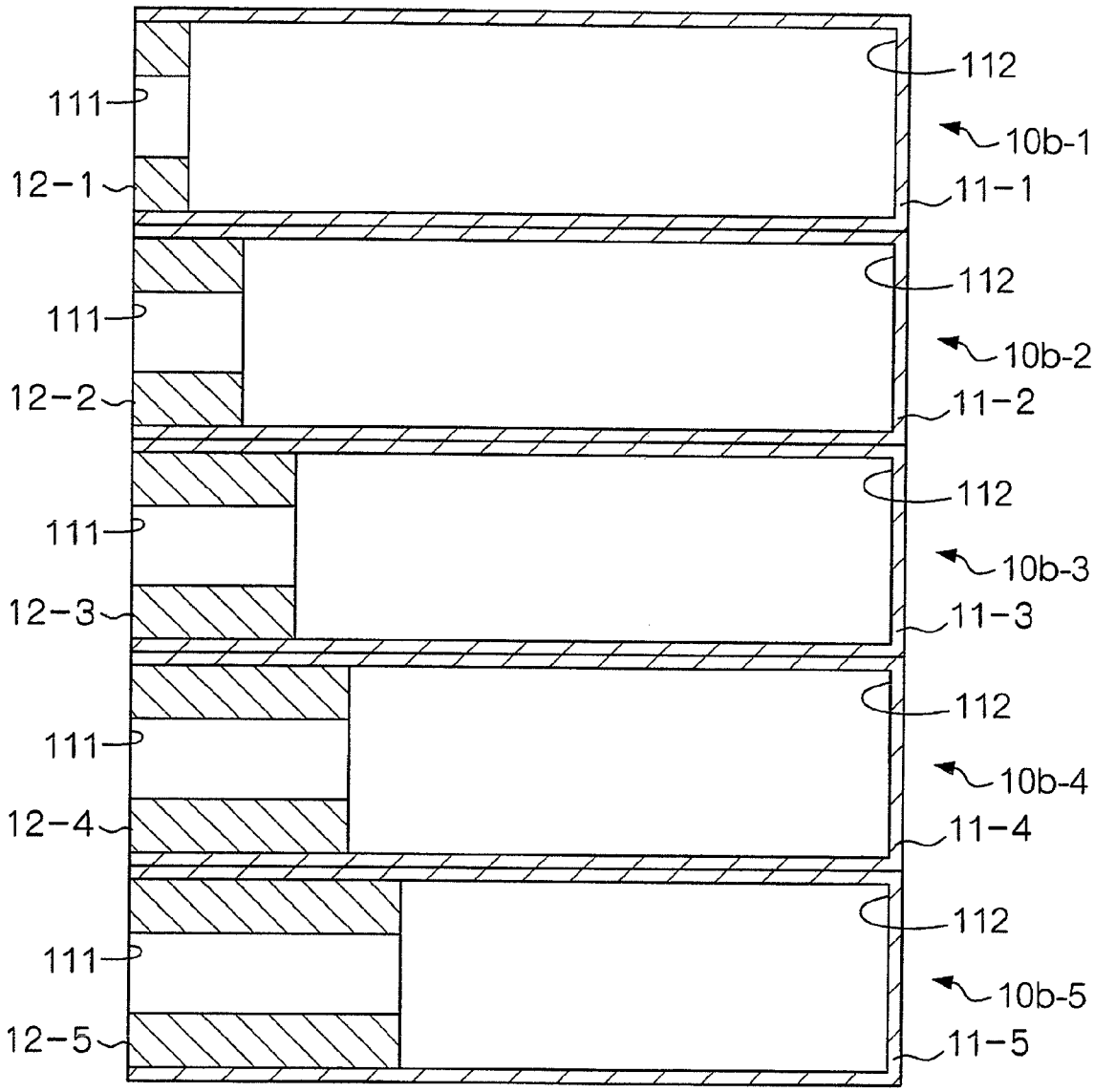
FIG. 17 is a longitudinal sectional view showing an acoustic resonator according to a fifth embodiment of the present invention, which is fanned using a plurality of resonant units.

FIG. 17 is a longitudinal sectional view of an acoustic resonator according to a fifth embodiment of the present invention. The acoustic resonator of the fifth embodiment includes a plurality of resonance units (each corresponding to the acoustic resonator 10 of the foregoing embodiments), which are miffed together such that their opening ends 111 and closed ends 112 adjoin together respectively. FIG. 17 shows five resonance units 10*b*-1 through 10*b*-5 which are constituted of pipe members 11-1 through 11-5 and resistance members 12-1 through 12-5 having different lengths, forming different lengths of hollow cavities. Specifically, the lengths of the resistance members 12-1 through 12-5 are gradually increased in the order of the resonance units 10*b*-1 through 10*b*-5. All the resonance units 10*b*-1 through 10*b*-5 have the same basic constitution. Considering the measurement result of FIG. 6, the resonance frequency gradually decreases in the order of the resonance units 10*b*-1 through 10*b*-5, thus achieving a sound pressure reduction effect and a particle velocity increase effect in a broad frequency range. The fifth embodiment is able to vary the resonance frequency by simply changing the length of the hollow cavity of each pipe member; in other words, the fifth embodiment does not need a troublesome design in producing each pipe member in different dimensions. For this reason, the fifth embodiment may be advantageous in terms of the manufacturing cost and simplicity of design. Since each pipe member has the same length, the fifth embodiment demonstrates a good artistic design. In addition, the resonance frequency can be easily changed by simply replacing each resistance member with a desirable one.

6. Sixth Embodiment

Figure 18A:
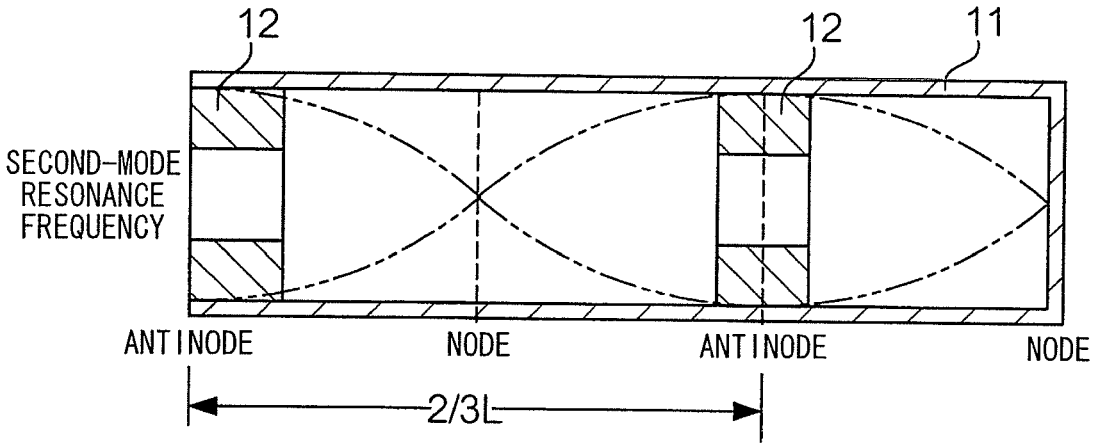
FIG. 18A is a longitudinal sectional view showing an acoustic resonator according to a sixth embodiment of the present invention, wherein two resistance members are disposed in a pipe member at antipodes of the particle velocity distribution of standing waves of a second-mode resonance frequency.
Figure 18B:
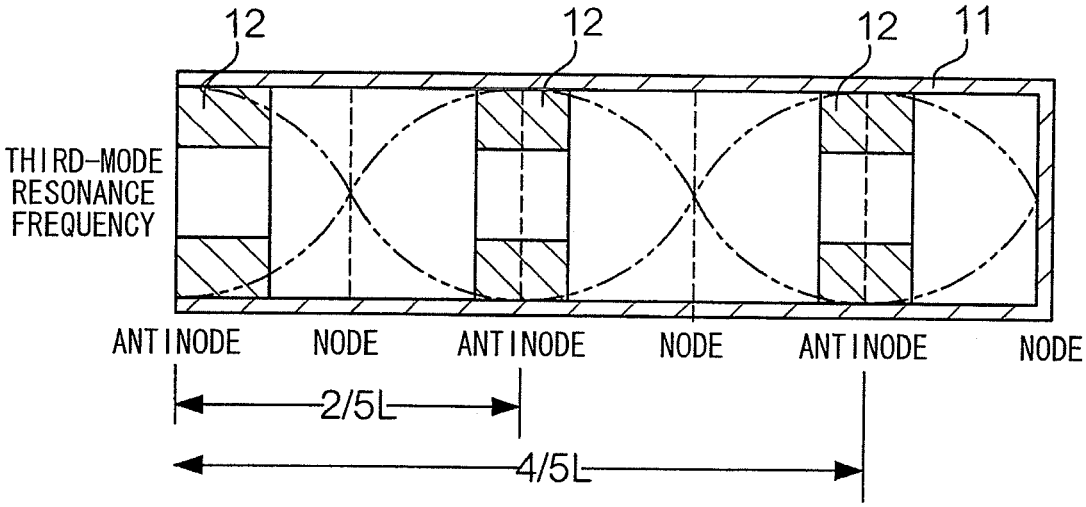
FIG. 18B is a longitudinal sectional view of the acoustic resonator of the sixth embodiment, wherein three resistance members are disposed in the pipe member at antinodes of the particle velocity distribution of standing waves at a third-mode resonance frequency.

In the foregoing embodiments, the resistance member 12 is positioned relative to the opening end 111 of the pipe member 11 in the acoustic resonator 10 since a standing wave emerges with an antinode of the particle velocity distribution at the first-mode resonance frequency in proximity to the opening end 111; but this is nota restriction. The inventors have focused on harmonic overtones whose antinodes emerge differently of antinodes of the standing wave at the first-mode resonance frequency. FIG. 18A shows that standing waves emerge with two antinodes of the particle velocity distribution at the second-mode resonance frequency, wherein these antinodes emerge at the opening end 111 (i.e. an initial pipe length position) and a pipe length position of L×2/3 (measured from the opening end 111) respectively. This indicates that the second-mode resonance frequency can be decreased by disposing two resistance members 12 at the opening end 111 and the pipe length position of L×2/3 which are commensurate with two antinodes of the particle velocity distribution. FIG. 18B shows that standing waves emerge with three antinodes of the particle velocity distribution at the third-mode resonance frequency, wherein these antinodes emerge at the opening end 111, a pipe length position of L×2/5, and a pipe length position of L×4/5. This indicates that the third-mode resonance frequency can be decreased by disposing three resistance members 12 at the opening end 111, the pipe length position of L×2/5, and a pipe length position of L×4/5 which are commensurate with three antinodes of the particle velocity distribution. In respect of harmonic overtones, their resonance frequencies can be decreased into a low frequency range by simply disposing resistance members at antinodes of the particle velocity distribution.

Of course, it is possible to dispose the resistance members 12 at other positions regardless of antinodes of the particle velocity distribution. Although a higher particle velocity may significantly enhance the foregoing acoustic phenomenon so as to improve the loss factor and the effect of shifting the resonance effect, the placement of the resistance members 12 at other positions may also contribute to the occurrence of the acoustic phenomenon.

7. Variations

The foregoing embodiments can be further modified in various ways as follows, (1) The foregoing embodiments refer to an acoustic resonator whose housing is a "closed" pipe member having one opening end opposite to the closed end, whereas it is possible to adopt an "open" pipe member whose opposite ends are opened. Since the first-mode resonance frequency of the open pipe member has a long wavelength which is double of the length of a hollow cavity (defined between the opposite opening ends), the open pipe member needs to be increased in length when realizing the same resonance frequency as the closed pipe member. However, the acoustic phenomenon is caused by the resistance member, it is possible to achieve the loss factor and the effect of shifting the resonance frequency into a low frequency range by way of the open pipe member incorporating the resistance member.

(2) In the foregoing embodiments, the low resistance region T2 is a hollow space having no resistance material, whereas it is possible to fill the low resistance region T2 with a resistance material. In this case, the resistance material of the low resistance region T2 needs to be lower in resistance than the high resistance region T1 of the resistance member, whereby it is possible to cause the acoustic phenomenon. In addition, the high resistance region T1 is not necessarily composed of a single resistance material; that is, the high resistance region T1 can be composed of multiple resistance materials. In this case, the resistance of the high resistance region T1 can be gradually increased in proportion to the distance from the low resistance region T2. Alternatively, the high resistance region T1 can be composed of a single resistance material whose resistance is varied in a step-by-step manner or in a continuous manner.

(3) It is preferable that an antinode region of the particle velocity distribution (maximizing the particle velocity) be relatively increased in resistance compared to other regions. Herein, the particle velocity of the antinode region is directly measured using the foregoing particle velocity sensor, whereas it can be measured in accordance with another method. For example, a microphone is used to measure a sound pressure at each measurement position inside an acoustic resonator, thus calculating the particle velocity based on the measured sound pressure. It is well known that a characteristic impedance of a medium can be calculated by dividing the sound pressure of a plan propagating wave by the particle velocity. This indicates that the particle velocity can be univocally calculated based on the already-known values of the sound pressure and the characteristic impedance (or resistance). Considering the acoustic property shown in FIGS. 18A and 18B, the resonance frequency can be calculated based on the pipe length and the condition whether the pipe member is opened at one end or both ends, thus theoretically estimating antinodes of the particle velocity distribution. In this connection, the resistance at each measurement position of the hollow cavity of the pipe member can be actually measured using the known measurement device. Since the resistance differs based on the type and the density of the resistance material, it is unnecessary to actually measure the resistance, which can be estimated in light of the already known relationship between resistances at various regions specified in light of the type and the density of the resistance material.

(4) The acoustic resonators of the foregoing embodiments can be arranged in various types of sound chambers such as soundproof chambers, halls, theaters, listening rooms of audio devices, conference rooms, compartments of transportation machines, and housings of speakers and musical instruments. Specifically, acoustic resonators can be embedded inside double-walls or below floors in rooms. Acoustic resonators can be installed in cabins (accommodating for humans), machinery rooms and luggage compartments of vehicles such as aircrafts, ships, automobiles, and space stations. Acoustic resonators can be applied to headphones, earphones and hearing aids so as to attenuate resonances in internal spaces. Acoustic resonators can be installed in ducts and ventilation systems of buildings and vehicles. Acoustic resonators can be installed in supply/exhaust pipes of motorcycles. That is, acoustic resonators are used to improve silence/quietness in various rooms and spaces.

(5) Openings of acoustic resonators need to be positioned to decrease sound pressures relative to antinodes of natural oscillations having specific natural frequencies in spaces. This makes it possible to reliably reduce sound pressures at any positions in addition to antinodes of natural oscillations, thus decreasing noise levels in spaces. Generally speaking, a natural oscillation occurs in a sound field of a certain space in which incoming waves are overlapped each other while being repetitively subjected to reflection, absorption and diffraction. In particularly, the inventors have figured out an outstanding finding that an antinode of the sound pressure distribution emerges at a specific position in a space causing a natural oscillation of a specific natural frequency significantly isolated on the frequency axis, and a sound pressure at the specific position greatly affect the silence/quietness in the entire space. By decreasing the sound pressure at an antinode position or by increasing the particle velocity, it is possible to decrease the sound-pressure amplitude in the natural oscillation, thus effectively decreasing a noise level in a low frequency range in the space.

Lastly, the present invention is not necessarily limited to the foregoing embodiments and variations, which can be adequately combined together or further modified in various ways within the scope of the invention as defined in the appended claims.

What is claimed is:

1. An acoustic resonator, comprising:

a pipe defining a resonant chamber having a longitudinal axis, the pipe having an open end and a closed end;

a resonating fluid located in the resonant chamber;

a resistance member extending from the open end of the resonant chamber inwardly toward, but not extending to, the closed end of the resonant chamber, the resistance member having first and second end surfaces, the first end surface being located at the open end of the resonant chamber, the second end surface being located at the antinode of a standing wave occurring in the resonant chamber, the resistance member including a high resistance region and a radially inward low resistance region located adjacent one another as viewed along a plane extending perpendicular to the longitudinal axis and extending through the resistance member, the high and low resistance regions presenting different resistances to motion of the resonating fluid, whereby the primary resonance frequency of the resonator is lower than it would be absent the presence of the resistance member.

2. The acoustic resonator of claim 1, wherein the resonant chamber has a constant cross section along said longitudinal axis.

3. The acoustic resonator of claim 1, wherein the resonant chamber is cylindrical in shape.

4. The acoustic resonator of claim 1, wherein the resonant fluid is air.

5. The acoustic resonator of claim 4, wherein the open end of the resonator chamber is directly adjacent an ambient atmosphere.

6. The acoustic resonator of claim 1, wherein the high resistance region of the resistance member is made of a porous material.

7. The acoustic resonator of claim 6, wherein the low resistance region of the resistance member is a hole in the resistance member.

8. The acoustic resonator of claim 7, wherein the resistance member is cylindrical in shape and the outer surface of the resistance member is located adjacent an outer surface of the resonant chamber lying adjacent the open end.

9. The acoustic resonator of claim 1, wherein the longitudinal axis of the resonant chamber is straight.

10. The acoustic resonator of claim 1, wherein the longitudinal axis of the resonant chamber is curved.

11. The acoustic resonator of claim 1, wherein the longitudinal axis of the resonant chamber folds back on itself into a U-shape.

12. An acoustic resonator, comprising:

a plurality of pipes of the same length, each pipe defining a respective resonant chamber having a longitudinal axis, an open end and a closed end, the length of each of the resonant chambers being equal to one another;

a respective resonating fluid located in each of the resonant chambers;

each pipe having an associated resistance member located in its associated resonant chamber, each resonant member extending from the open end of its associated resonant chamber inwardly toward, but not extending to, the closed end of its associated resonant chamber, each resistance member including a high resistance region and a low resistance region located adjacent one another as viewed along a plane extending perpendicular to the longitudinal axis of its associated resonant chamber and extending through the resistance member, the high and low resistance regions presenting different resistances to a motion of the resonating fluid in its associated resonant chamber, each resistance member extending a different distance into its associated resonant chamber whereby the primary resonance frequency of each of the resonant chambers is different.

13. The acoustic resonator of claim 12, wherein each of the resonant chambers have a constant cross section along its longitudinal axis.

14. The acoustic resonator of claim 12, wherein each of the resonant chambers is cylindrical in shape.

15. The acoustic resonator of claim 12, wherein each of the resonant fluids is air.

16. The acoustic resonator of claim 15, wherein the open end of each resonator chamber is directly adjacent an ambient atmosphere.

17. The acoustic resonator of claim 12, wherein each of the resistance members has a first end located at the open end of its associated resonant chamber and a second end located internally of its associated resonant chamber.

18. The acoustic resonator of claim 12, wherein the low resistance region of each resistance member is located axially internally of the high resistance region thereof.

19. The acoustic resonator of claim 12, wherein the high resistance region of each resistance member is made of a porous material.

20. The acoustic resonator of claim 19, wherein the low resistance region of each resistance member is a hole formed therein.

21. The acoustic resonator of claim 20, wherein each resistance member is cylindrical in shape and the outer surface of each resistance member is located adjacent an outer surface of its associated resonant chamber lying adjacent the open end thereof.

22. The acoustic resonator of claim 12, wherein the longitudinal axis of each of the resonant chambers is straight.

23. The acoustic resonator of claim 12, wherein the longitudinal axis of each of the resonant chambers is curved.

24. The acoustic resonator of claim 12, wherein the longitudinal axis of each of the resonant chambers folds back on itself into a U-shape.

25. The acoustic resonator of claim 12, wherein the low resistance region of each resistance member is located axially externally of the high resistance region thereof.

26. The acoustic resonator of claim 12, wherein each resistance member associated with a respective pipe has first and second end surfaces, the first end surface being located at the open end of its associated resonant chamber, the second end surface being located at the antinode of a standing wave occurring in its associated resonant chamber, the high resistance region of each resistance member being located radially inward of the low resistance region of that resistance member.

27. The acoustic resonator of claim 26, wherein standing wave of each respective resonant cavity is the standing wave formed at the primary resonant frequency of the respective resonant cavity.

28. The acoustic resonator of claim 1, wherein the standing wave is the standing wave formed at the primary resonant frequency of the resonant chamber.

* * * * *